US005596770A

United States Patent [19]

Kunesh

[11] Patent Number: 5,596,770

[45] Date of Patent: Jan. 28, 1997

[54] TWO-PLY INFLATABLE SOCK

[76] Inventor: J. Denise Kunesh, 2415 Tanglewood Cir., Stillwater, Okla. 74074

[21] Appl. No.: 551,715

[22] Filed: Nov. 1, 1995

[51] Int. Cl.[6] ..... A41B 11/00

[52] U.S. Cl. ..... 2/239; 2/DIG. 3

[58] Field of Search ..... 2/239, DIG. 3, 2/22, 240, 267; 128/DIG. 20, 882; 601/152; 607/111; 602/13, 30; 36/71, 88, 93, 29, 92

[56] References Cited

U.S. PATENT DOCUMENTS

| | | | |
|---|---|---|---|
| 2,582,648 | 1/1952 | Mowbray | 2/239 |
| 2,774,152 | 12/1956 | Alber | 128/DIG. 20 |
| 3,431,658 | 3/1969 | Finn | 36/58.5 |
| 3,760,056 | 9/1973 | Rudy | 264/299 |
| 3,791,375 | 2/1974 | Pfeiffer | 128/2.1 R |
| 3,824,992 | 7/1974 | Nicholson et al. | 128/DIG. 20 |
| 3,888,242 | 6/1975 | Harris et al. | 128/64 |
| 4,550,446 | 11/1985 | Herman | 2/239 |
| 4,722,332 | 2/1988 | Saggers | 128/DIG. 20 |
| 4,724,627 | 2/1988 | Sisco | 36/119 |
| 4,995,173 | 2/1991 | Spier | 36/29 |
| 5,094,252 | 3/1992 | Stumpf | 128/DIG. 20 |
| 5,121,962 | 6/1992 | Weber et al. | 297/214 |
| 5,252,373 | 10/1993 | Ganske et al. | 428/68 |
| 5,257,470 | 11/1993 | Auger et al. | 36/88 |
| 5,317,821 | 6/1994 | Vargo | 36/93 |
| 5,329,640 | 7/1994 | Hourigan | 2/239 |
| 5,330,249 | 7/1994 | Weber et al. | 297/214 |
| 5,354,260 | 10/1994 | Cook | 602/13 |
| 5,378,223 | 1/1995 | Grim et al. | 128/DIG. 20 |
| 5,403,265 | 4/1995 | Berguer et al. | 602/13 |
| 5,430,896 | 7/1995 | Bisley | 2/239 |

*Primary Examiner*—Amy B. Vanatta
*Attorney, Agent, or Firm*—Head, Johnson & Kachigian

[57] ABSTRACT

A two-ply inflatable sock whose dimension and fit is adjustable by the wearer is provided. The sock has an inner layer constructed of a wicking material and a water repellant outer layer. An inflatable toe cup positioned between the inner and outer layers and is adapted to encase the toes of the wearer, while an inflatable heel collar, likewise disposed between the inner and outer layers, is adapted to circumscribe the heel. The wearer may adjustably control the inflation of the toe cup and heel collar by manipulating finger pump and air release mechanisms so as to alter the dimension and fit of the sock. The toe cup and heel collar may be partially filled with a gel material, such as a plastisol or hydrogel.

8 Claims, 2 Drawing Sheets

TWO-PLY INFLATABLE SOCK

BACKGROUND OF THE INVENTION

1. Technical Field

The present invention relates generally to socks, and, more specifically, to a two-ply sock whose dimension and fit is adjustable by the wearer.

2. Background

Blisters are commonly caused by a persistent physical trauma, such as the rubbing of the heel against the inner surface of a shoe. Though blisters can affect anyone, certain individuals are predisposed to this problem. Those with narrow feet, especially in the heel, along with those who have slightly different sized feet, are prone to blisters due to the ill-fitting nature of off-the-rack shoes. For these individuals, blistering becomes more pronounced during athletic activity, such as hiking, jogging, golfing and any other activity where prolonged walking or running is required. As the heel is not securely held against the back of the shoe, but instead slides back and forth against the inner wall of the shoe, a blister develops. The toes may also develop blisters or bruises from the action of the foot sliding forward in the shoe, crunching the toes against the tip of the shoe.

The foot of a diabetic, or one with an impaired circulatory system, is even more susceptible to trauma, particularly around the heel and bony prominences of the foot. Foot ulcers are not uncommon and may lead to infection and gangrene. Due to diabetic neuropathy, the individual may not perceive the trauma, thus complicating the condition.

Further complications are caused by the dank environment to which the foot is exposed during long bouts of activity. Sweat encourages fungal and bacterial. invasions, as does moisture seeping in from outside sources.

Some have attempted to design shoes or socks having adjustable features to increase comfort, such as those disclosed in U.S. Pat. Nos. 2,582,648; 3,431,658; 3,760,056; 4,724,627; 4,995,173; 5,257,470; 5,317,821; and 5,329,640.

Hourigan (U.S. Pat. No. 5,329,640) discloses an adjustably cushioned sock including flexible tubing positioned internally of the sock to receive and retain air therein. The tubing is formed so as to constitute two separate independent circuits—one extending over the top of the foot and serving to cushion the instep and ankle and the other extending to provide cushioning for the underside of the foot. A pump is provided to supply air to each circuit, and a release valve permits the air contained therein to be exhausted. The inventor specifies that the socks can be used to compensate for slight misfits in shoes by controlling the amount and location of the inflation.

However, Hourigan's focus on cushioning the instep, ankle, and underside of the foot results in an inordinate amount of structure within the sock, and, while allowing for adjustment, the sock appears to be alterable almost exclusively in the vertical plane, i.e. cushion is provided above and below the foot. Hourigan is not concerned with protecting the contours of the heel and toes against physical trauma caused by heel slippage and the cramming of the toes against the tip of the shoe. Nor does he deal with problems caused by excessive moisture about the foot.

It is thus an object of the present invention to provide an inflatable sock having minimal internal structure whose dimension and fit is adjustable by the wearer so that it may securely, firmly, yet softly hold the heel in place and so that the toes are not pummelled against the tip of a shoe or boot.

It is a further object to provide persons having slightly different sized feet with a comfortable sock-like garment that adapts to the size of the misfit shoe.

It is another object to provide diabetic persons with a sock that protects the foot from trauma caused by ill-fitting shoes, pebbles, and the like, while at the same time preventing a moisture build up that might lead to infection or other complication.

SUMMARY OF THE INVENTION

The present invention improves the prior art by providing a two-ply inflatable sock having an inner layer constructed of a wicking material and a water repellant outer layer. An inflatable toe cup positioned between the inner and outer layers is adapted to encase the toes of the wearer, while an inflatable heel collar, likewise, disposed between the inner and outer layers, is adapted to circumscribe the heel. The wearer may adjustably control the inflation of the toe cup and heel collar so as to alter the dimension and fit of the sock.

Preferably, the inner layer is constructed of polypropylene or such other lightweight wicking material as will pull moisture away from the foot. The outer layer is made of GORETEX or its equivalent. The toe cup is seam stitched to the inner layer and, when the sock is pulled on, surrounds and protects the toes along their entire length. The heel collar circumscribes the heel from the lateral side of the foot just below and slightly forward of the ankle to the same location on the medial side of the foot. No part of the heel collar projects under the heel. Like the toe cup, the heel collar is seam stitched to the inner layer. The wearer adjustably controls the inflation of the toe cup and heel collar by manipulating finger pump and air release mechanisms located on the body of the sock. One finger pump is connected by an air conduit to an air inlet on the toe cup, while another is connected in a similar fashion to the heel collar. Each finger pump has a companion release valve located in close proximity thereto.

In accordance with another aspect of the invention, the toe cup and heel collar are partially filled with a gel material, such as a plastisol composition or a hydrogel. This gel material serves to softly protect the heel and toes from abrasive and compressive forces. The properties of the toe cup and heel collar are then augmented by inflation with air.

One advantage of the invention is its comfort. It has little internal structure as compared with prior art devices. It is also focused on the heel and toe of the foot rather than the instep and sole. This allows for a better fit of the foot into the shoe and for superior protection of the bony prominences that are susceptible to blisters, abrasions and bruises. The invention also wicks sweat away from the foot, while concomitantly repelling moisture from outside sources to prevent irritation and abate microbial growth. Partially filling the toe cup and heel collar with gel softly cushions the foot while improving the fit of the sock upon the foot and within the shoe.

Still other objects and advantages of the present invention will become readily apparent to those skilled in this art from the following detailed description, wherein there is shown and described only the preferred embodiment of the invention, simply by way of illustration of the best mode contemplated for carrying out the invention. As will be realized, the invention is capable of modifications in various obvious respects, all without departing from the invention. Accordingly, the description. should be regarded as illustrative in nature, and not as restrictive.

DETAILED DESCRIPTION OF THE PREFERRED EMBODIMENT

Figure 1:
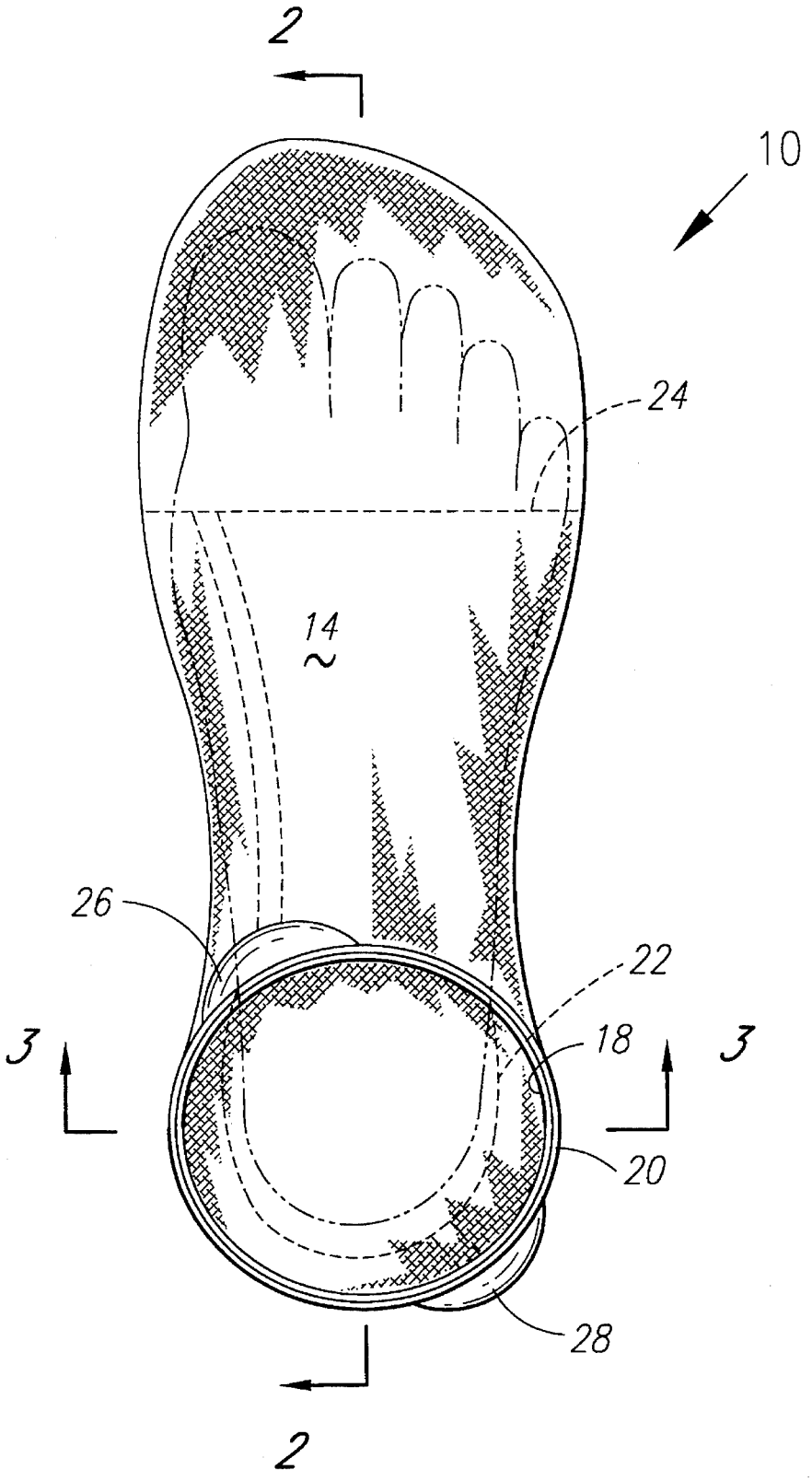
FIG. 1 is a top view of the preferred embodiment of the invention shown pulled over a foot.
Figures 2, 3:
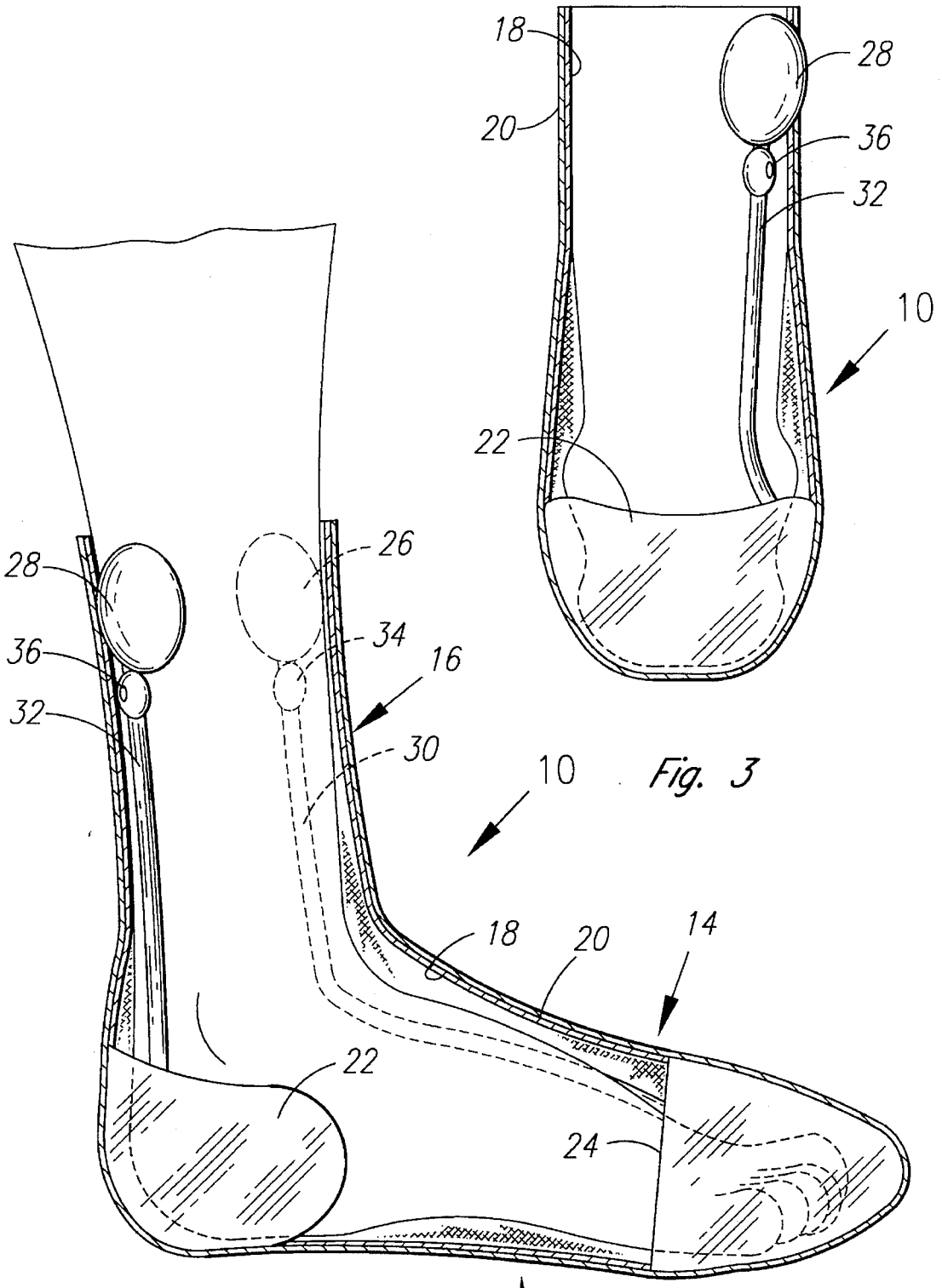
FIG. 2 is a cut away side view of the preferred embodiment taken along line 2—2 of FIG. 1.
FIG. 3 is a cut away rear view of the preferred embodiment taken along line 3—3 of FIG. 1.

Referring to FIGS. 1–3, there is shown the preferred embodiment of the invention, generally indicated by the reference numeral 10. The sock 10 is shown in FIGS. 1–3 as pulled over a foot in a conventional manner. In FIG. 1, the sock 10 is pulled over a right foot, while in FIG. 2 the sock 10 is positioned over a left foot.

As is conventional, the sock 10 has a sole 12, an instep 14, and an upper, vertically oriented body portion 16 which extends from just above the ankle of the foot to the mid-calf region of the leg.

The sock 10 has two layers, an inner layer 18 and an outer layer 20. Inner layer 18 is preferably made from a wicking material, an example of which is polypropylene. Outer layer 20 on the other hand is preferably constructed of a material having water resistant properties, such as GORETEX, a polytetrafluoroethylene fabric.

Between inner layer 18 and outer layer 20 there is disposed a heel collar 22 and a toe cup 24.

As best seen in FIGS. 2 and 3, heel collar 22 circumscribes the heel from the lateral side of the foot just below and slightly forward of the ankle to the same location on the medial side of the foot. No part of the heel collar 22 projects under the heel. The toe cup 24 is shaped so as to accept and encase the toes of the wearer such that they are surrounded and protected along their entire length. The heel collar 22 and toe cup 24 are made of a malleable and air impermeable material, such as a lightweight plastic, and are seam stitched to inner layer 18.

Heel collar 22 and toe cup 24 are also formed as pockets having air inlets so as to be inflatable, and the wearer may adjustably control the inflation of the heel collar 22 and toe cup 24 to alter the dimension and fit of the sock 10. The wearer adjustably controls the inflation of the heel collar 22 and toe cup 24 by manipulating two finger pump assemblies 26, 28 located on the body 16 of the sock 10. A first finger pump 26 is connected by an air conduit 30 to an air inlet on the toe cup 24, while a second finger pump 28 is similarly connected to the heel collar 22 by air conduit 32. The air conduits 30, 32 are of a minimal diameter and are positioned within the sock 10 so as to be comfortable to the wearer. Companion release valves are located in close proximity to the finger pumps 26, 28. A first release valve 34 is positioned beneath first finger pump 26 allowing for the egress of air from the toe cup 24 through air conduit 30. Similarly, a second release valve 36 is placed beneath the second finger pump 28 for discharging air from the heel collar 22 via air conduit 32.

Many different well known types and structures of finger pump and release valve assemblies will adequately function to inflate and deflate the heel collar 22 and toe cup 24 including mechanisms akin to those disclosed in U.S. Pat. Nos. 3,760,056; 4,724,627; 4,995,173; 5,257,470; and 5,329,640, which disclosures are incorporated by reference herein.

In accordance with another aspect of the invention, the heel collar 22 and toe cup 24 are partially filled with a gel material. Several known gel materials would suffice, including various plastisols and other viscoelastic materials, such as a highly plasticized polyvinyl chloride gel, and further including hydrogels. As used herein, the term hydrogel includes all colloids in which the particles are in the external or dispersion phase and water is in the internal or dispersed phase. The gel material serves to softly protect the heel and toes from abrasive and compressive forces. The properties of the heel collar 22 and toe cup 24 are then augmented by inflation with air.

In use, the wearer pulls the sock 10 over the foot in a conventional manner. The foot may then be inserted into a shoe or boot and the heel collar 22 and toe cup 24 inflated to the extent necessary to prevent heel slippage and cramming of the toes toward the tip of the shoe. Since the finger pump and release valve assemblies 26, 28, 34, 36 are located on the body 16 of the sock 10, the degree of inflation of the heel collar 22 and toe cup 24 may be readjusted as necessary during use.

The sock 10 as described above is comfortable to the wearer owing to the minimal amount of internal structure contained therein. The sole of the foot is completely free of tubes, pads or other irritants, as is the instep. Instead of providing structure under weightbearing surfaces or above the foot and below the tongue of the shoe, the invention is focused on the heel and toe of the foot. This allows for a better fit of the foot into the shoe and for superior protection of the bony prominences that are susceptible to blisters, abrasions and bruises.

Still further, the inner layer 18 of the sock 10 works to wick sweat away from the foot, while the outer layer 20 repels moisture from outside sources. This dual action prevents irritation and helps abate microbial growth.

Persons with narrow heels or different size feet, diabetics and those having circulatory problems that alter foot size will all benefit from the advantages offered by the present invention.

While the invention has been described with a certain degree of particularity in relation to the drawings attached hereto, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A two-ply sock, comprising:

(a) an inner layer constructed of a wicking material;

(b) a water repellant outer layer;

(c) an inflatable toe cup disposed between said inner layer and said outer layer adapted to encase the toes of a wearer;

(d) an inflatable heel collar disposed between said inner layer and said outer layer adapted to circumscribe the heel of the wearer; and (e) means for the wearer to adjustably control the inflation of said toe cup and said heel collar so as to alter the dimension and of said sock.

2. The sock according to claim 1, wherein said toe cup and said heel collar are partially filled with a gel material.

3. The sock according to claim 2, wherein said gel material is a highly plasticized polyvinyl chloride.

4. The sock according to claim 2, wherein said gel material is a hydrogel.

5. The sock according to claim 1, wherein said inner layer is constructed of polypropylene.

6. The sock according to claim 1, wherein said outer layer is constructed of polytetrafluoroethylene.

7. The sock according to claim 1, wherein said means to adjustably control the inflation of said toe cup and said heel collar comprises a first finger pump and release valve assembly connected by an air conduit to said toe cup and a second finger pump and release valve assembly connected by an air conduit to said heel collar.

8. A two-ply sock, comprising:

(a) an inner layer constructed of polypropylene;

(b) a water repellant outer layer;

(c) an inflatable toe cup disposed between said inner layer and said outer layer adapted to encase the toes of a wearer, said toe cup having an air inlet and being partially filled with a gel material selected from the group consisting of plastisols and hydrogels;

(d) an inflatable heel collar disposed between said inner layer and said outer layer adapted to circumscribe the heel of the wearer, said heel collar having an air inlet and being partially filled with said gel material;

(e) a first finger pump and release valve assembly adapted for fluid communication with said toe cup via a first air conduit; and (f) a second finger pump and release valve assembly adapted for fluid communication with said heel collar via a second air conduit.

* * * * *